US005992801A

United States Patent [19]

Torres

[11] Patent Number: 5,992,801

[45] Date of Patent: Nov. 30, 1999

[54] PIPE GRIPPING ASSEMBLY AND METHOD

[76] Inventor: Carlos A. Torres, 748 Blalock, Houston, Tex. 77024

[21] Appl. No.: 08/670,639

[22] Filed: Jun. 26, 1996

[51] Int. Cl.[6] ..... B65H 59/10

[52] U.S. Cl. ..... 248/49; 166/209; 188/67

[58] Field of Search ..... 248/49, 65.1, 316.2, 248/316.3; 188/67; 166/209

[56] References Cited

U.S. PATENT DOCUMENTS

| | | | |
|---|---|---|---|
| 2,612,671 | 10/1952 | Martin | 188/67 |
| 3,096,075 | 7/1963 | Brown | 188/67 X |
| 3,472,535 | 10/1969 | Kinley | 188/67 X |
| 3,579,753 | 5/1971 | Pryor | 188/67 X |
| 4,306,742 | 12/1981 | Hardcastle | 188/67 X |
| 5,009,289 | 4/1991 | Nance | 188/67 |
| 5,297,833 | 3/1994 | Willis et al. | 188/67 X |
| 5,732,909 | 3/1998 | Sonnier | 248/49 |

*Primary Examiner*—Derek J. Berger
*Attorney, Agent, or Firm*—Browning Bushman

[57] ABSTRACT

A primary pipe gripping mechanism and a backup, secondary pipe gripping mechanism are carried in a single tapered slip bowl. The primary gripping mechanism employs smooth surface pipe dies that set against and grip and hold the pipe without damaging the pipe surface. After the primary mechanism is set, toothed dies in the secondary gripping are automatically engaged with the pipe with only a minimal pipe gripping force. Accidental slippage of the pipe through the smooth dies sets the toothed dies down against a wedging surface to grip and hold the pipe to stop its downward movement. A resilient biasing device is used to urge the toothed dies away from the pipe before the smooth dies are set. Movement of the pipe relative to the already set, smooth dies automatically causes the toothed dies to set and grip the pipe to thereby limit the incidence of pipe damage to those situations in which pipe slippage occurs through the primary gripping mechanism.

18 Claims, 4 Drawing Sheets

FIG. 3
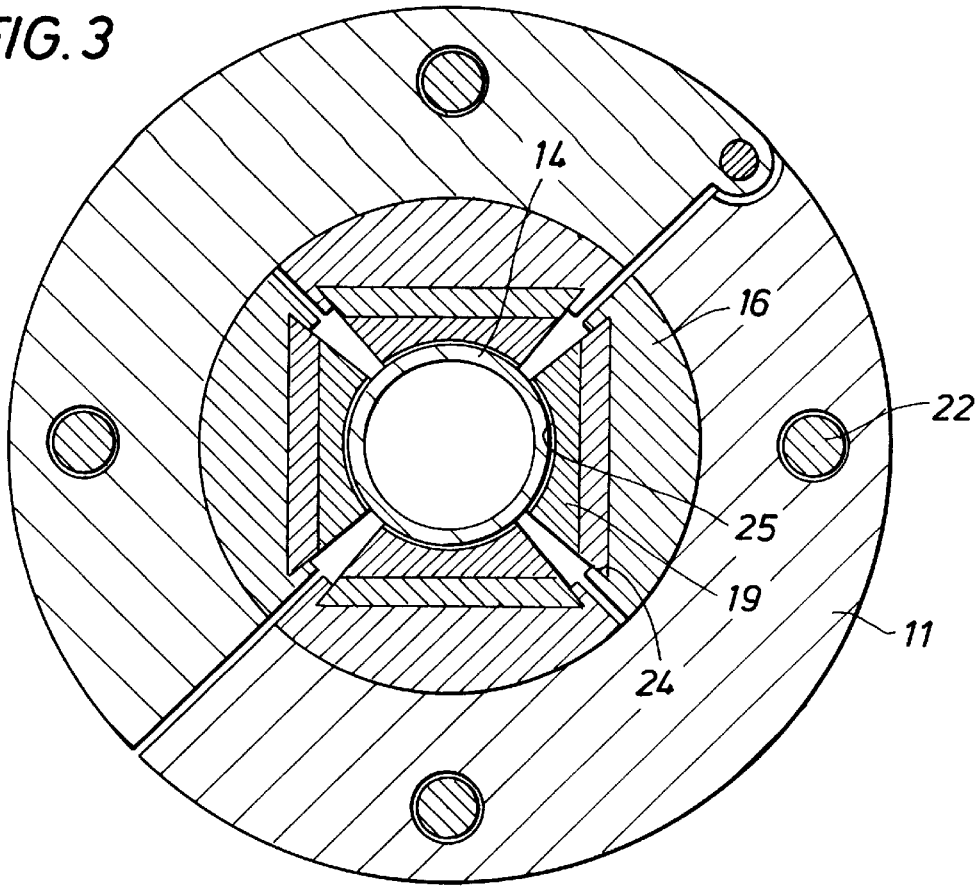
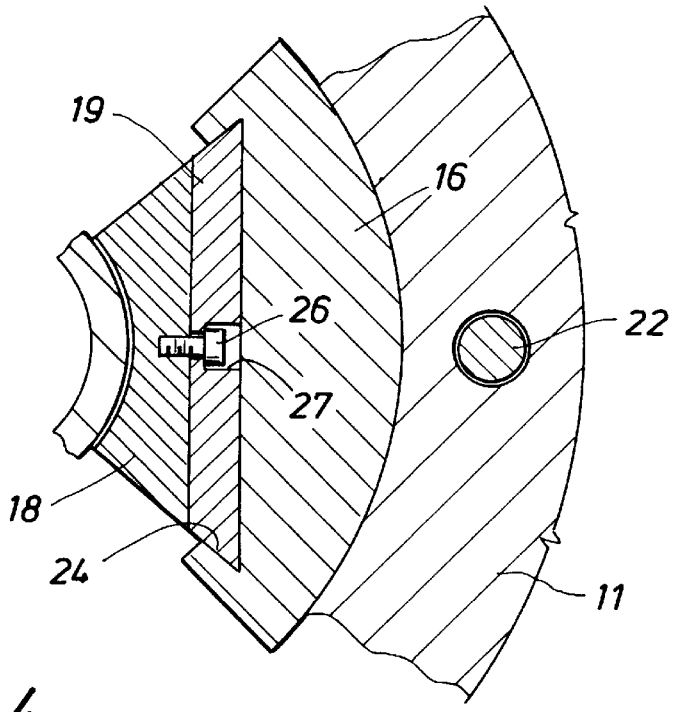
FIG. 4

PIPE GRIPPING ASSEMBLY AND METHOD

This application is related to U.S. patent application Ser. No. 08/670,640, entitled Pipe Gripping System and Method, invented by Errol A. Sonnier and filed contemporaneously with the present application.

BACKGROUND OF THE INVENTION

The present invention relates generally to devices used to temporarily grip and hold pipe used in the drilling and completion of wells. More specifically, the present invention relates to an assembly for temporarily gripping and supporting a well pipe in a manner to minimize damage to the pipe caused by the gripping mechanism.

Slip assemblies are customarily employed to temporarily grip and hold pipe as it is being run into or pulled from a well. In a conventional slip assembly, tapered slips, which are carried in a tapered slip bowl, are "set" into gripping engagement with the pipe extending through the center of the bowl by moving the slips into contact with the pipe and then slightly lowering the pipe to allow the slips to support the pipe weight. The surface friction between the slips and the pipe causes the slips to move with the pipe, which pushes the tapered slips axially downwardly into the tapered slip bowl. This relative movement between the tapered slips and the tapered bowl forces the slips radially toward each other to grip the pipe extending through the center of the assembly. As the weight of the string increases, the downward force on the slips increases, which, in turn, acts through the engaged tapered surfaces to increase the radial pipe gripping force exerted by the slips. The slips are released by first lifting the string to relieve the weight on the slips and then retracting the slips out of engagement with the pipe.

The slips are typically equipped with replaceable, steel slip-dies that contact and grip the pipe. Conventional steel dies are typically equipped with radially projecting teeth that are designed to penetrate the outer pipe surface to increase the gripping force of the slips. The usual slip setting procedure can produce die-tooth cuts in the pipe surfaces that decrease the thickness and structural strength of the pipe, provide a corrosion attack point, and otherwise detrimentally affect the pipe.

Efforts at reducing the scarring caused by die teeth include the use of slip dies with very small teeth or specially configured teeth or, in some cases, with no teeth at all. While the prior art designs produce reduced pipe damage, as compared with conventional steel toothed-dies, a primary problem with these designs is that the slips can sometimes fail to grip the pipe securely and thus permit the string to slide through the slip assembly. The problem is most likely to occur as the string weight increases or when the slip teeth become clogged with debris or when the string or slips are contaminated with oil or other slippery substances.

If the pipe string slides through the dies, in many cases, the downward slide is stopped suddenly when a pipe coupling at the end of a pipe joint engages the slip assembly. Such slippage is objectionable in that it allows the string to be mispositioned, and also damages the pipe surface as the pipe slides through the slips. Moreover, if the impact of the coupling striking the slip assembly is strong enough, the coupling may be knocked free of the coupling allowing the string to fall into the well.

One prior art design, described in U.S. Pat. No. 3,579,753, describes a smooth die system that employs a special die carriage design to increase the radial die forces acting on the pipe. The patented system requires a relatively complicated slip carrier design that can be expensive to produce and maintain. No provision is made in the patented system for preventing pipe slippage if the smooth die slips should malfunction.

Other prior art devices for holding pipe without damaging the pipe surface have generally included complex mechanisms that are expensive to build and maintain. These prior art devices also lack an effective backup holding mechanism to prevent pipe movement if the primary holding device fails.

SUMMARY OF THE INVENTION

A single tapered slip bowl is used to provide primary and secondary gripping and holding mechanisms for temporarily gripping and holding pipe that is being run into or pulled out of a well. The primary gripping mechanism comprises a set of relatively smooth surface dies that set against and hold the pipe without damaging the external pipe surface. The secondary mechanism comprises a set of relatively nonsmooth surface-dies that engage, but do not forcefully grip, the pipe when the primary mechanism is set. If the pipe slips through the primary gripping mechanism, the dies of the secondary mechanism are automatically pulled down by the pipe into set engagement with the pipe to prevent further downward pipe movement.

The assembly of the present invention thus functions to provide a primary gripping and holding mechanism that holds the pipe without inflicting surface damage on the pipe due to die teeth or other nonsmooth die-surface configurations while simultaneously providing a safety backup in the form of nonsmooth diesurface gripping and holding means that automatically function only when required.

In preferred forms of the invention, the primary and secondary gripping mechanisms are provided within the single tapered bowl of conventional elevator or spyder slip assemblies. One form of the invention employs smooth die elements disposed in the standard die slots of a conventional slip or elevator assembly to provide the primary gripping and holding mechanism. The secondary gripping mechanism is provided by a special assembly that also is carried in the die slot of the assembly and includes die teeth and oppositely tapered bearing surfaces that cause the die teeth to set on the pipe as the pipe is moved relative to the set primary gripping mechanism. Resilient biasing is provided to urge the die teeth in a direction away from the center line of the pipe before the primary gripping mechanism is set.

Another form of the present invention employs cooperating upper and lower tapered slip holding segments that are employed in place of a conventional single piece tapered slip holding segment. The upper and lower tapered segments respectively hold the non-smooth and smooth die segments. An adjustment mechanism holds the upper and lower slip holding segments to each other to adjust the radial movement of the two segments relative to each other resulting from axial movement of the two segments through the bowl. The adjustment mechanism permits the smooth dies to engage and set on the pipe while the non-smooth dies contact but do not firmly set on the pipe. The two segments are free to move axially and radially relative to each other so that movement of the pipe through the smooth dies pulls the toothed dies and their associated tapered segment into firm setting engagement with the pipe.

Accordingly, it will be appreciated that a primary object of the present invention is to provide a single bowl assembly that when set will grip and hold a pipe with smooth, non-damaging die surfaces while simultaneously providing a safety gripping and holding mechanism that is automatically actuated if the pipe moves through the set smooth dies.

Another object of the present invention is to provide an assembly for temporarily gripping and holding a pipe that employs a single conventional slip bowl to provide both a primary and a secondary gripping and holding mechanism for such pipe.

It is also an object of the present invention to provide a pipe gripping and holding assembly that permits adjustment of the secondary gripping mechanism to prevent such mechanism from being set until after the primary mechanism is set and pipe movement occurs through the set primary mechanism.

A related object of the present invention is to provide a biasing structure for urging the secondary gripping mechanism away from the pipe while the primary gripping mechanism is being set to allow the secondary gripping mechanism to engage the pipe without being set until after the primary gripping mechanism is set.

Still another object of the present invention to provide an assembly and method for gripping pipe in which the secondary gripping mechanism is prepared for automatic operation by the step of setting the primary gripping mechanism.

A related object of the invention is to provide an apparatus and method in which the secondary gripping mechanism is automatically removed from engagement with the pipe by the same mechanism or procedure that removes the primary gripping mechanism from the pipe.

These and other objects, advantageous and features of the apparatus and method of the present invention may be better appreciated and described with reference to the following drawings, specifications and claims.

BRIEF DESCRIPTION OF THE DRAWINGS

FIG. 3 is a horizontal cross sectional view taken along the line 3—3 of FIG. 2;

FIG. 4 is a partial horizontal cross sectional view taken along the line 4—4 of FIG. 2 illustrating details in the construction and operation of a preferred form of the secondary pipe gripping mechanism of the present invention;

Figure 1:
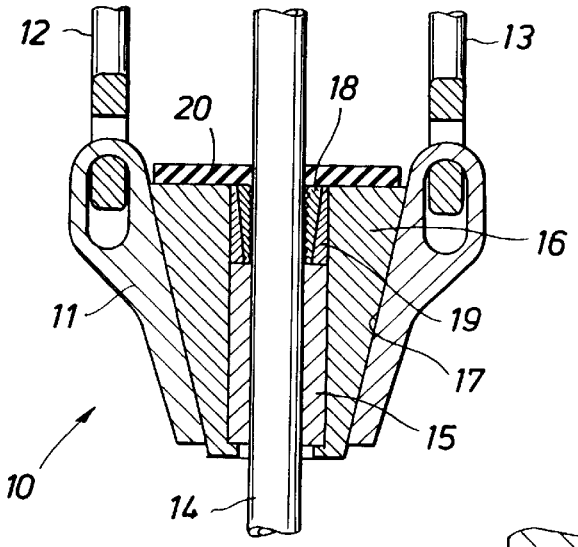
FIG. 1 is a vertical elevation, partially in vertical section, schematically illustrating a pipe elevator gripping a pipe with the pipe gripping assembly of the present invention.
Figure 6:
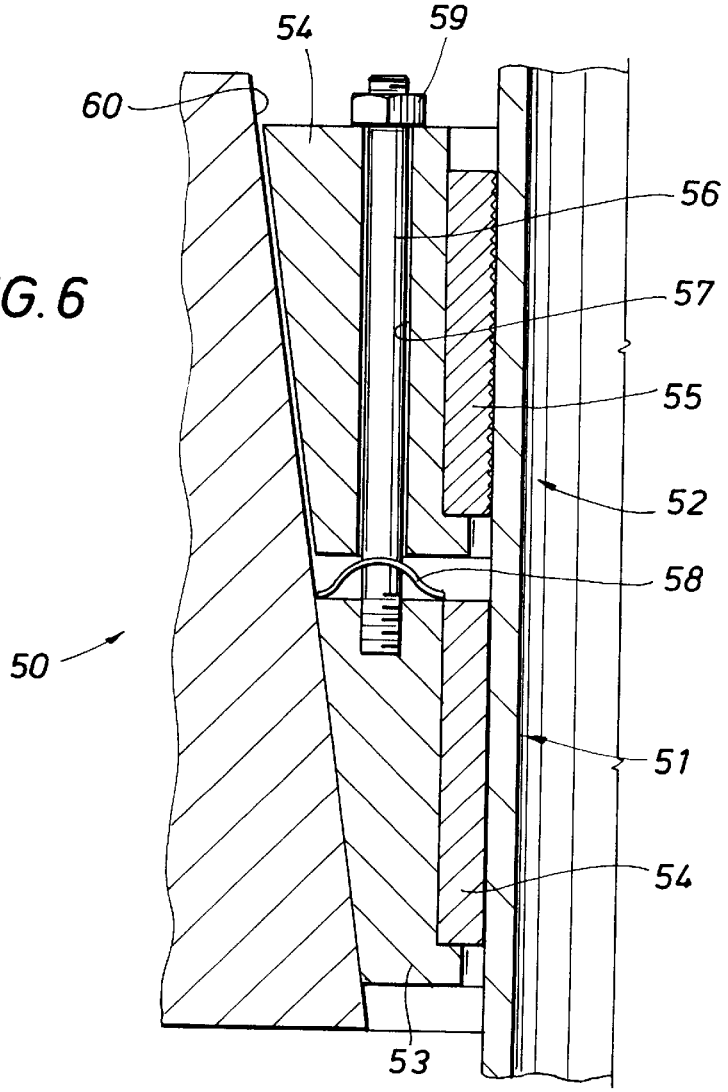
FIG. 6 is a vertical sectional view of a modified form of the primary and secondary pipe gripping mechanism of the present invention.

The spyder 101 and the elevator 104 each operate as a gripping device in a manner described previously with reference to the specific embodiments of the invention illustrated in FIG. 1 and/or FIG. 6. The spyder 101 and elevator 104 are selectively opened or closed, in a conventional sequence, to either raise or lower the pipe P as the bales 103 are raised or lowered relative to the rig floor 102.

DESCRIPTION OF THE PREFERRED EMBODIMENTS

The pipe gripping and holding apparatus of the present invention is indicated generally at 10 in FIG. 1 functioning as an elevator 11 in a pipe handling rig (not illustrated). The elevator 11, which is suspended from bales 12 and 13, is employed in a conventional manner to grip, hold and raise or lower a pipe 14 extending into a well (not illustrated).

In accordance with the teaching of the present invention, the elevator 11 is equipped with smooth surface pipe gripping dies 15 that are used as the primary pipe gripping and holding members from the elevator. The dies 15 are carried in conventional wedge-shaped slip segments 16 that in turn are carried within a tapered bearing surface 17 or slip bowl surface formed internally of the elevator 11.

Pipe dies 18 equipped with gripping teeth are employed as the secondary pipe gripping and holding members. The dies 18 which are also carried in the tapered slip segments 16, are equipped with wedge shaped backing sections 19 that function to drive the dies 18 radially into firm gripping engagement with the pipe 14 when the pipe moves down through the primary gripping members 15.

The elevator 11 may be a typical slip-grip, center latch elevator such as a conventional HYT or MYT elevator. Elevators of the center-latch design are hinged to form two half sections that are unlatched to open and receive the pipe. Once the elevator is latched closed around the pipe, the elevator is set by raising the elevator 11 causing resilient wiper elements 20 at the top of the slips segments 16 to drag along the pipe and force the segment 16 down against the bowl taper 17. The movement of the tapered slip segments 16 against the tapered bowl section 17 moves the dies 15 and 18 radially into contact with the pipe 14. Continued raising of the elevator causes the smooth die segments 15 to firmly grip and hold the pipe so that the pipe may be lifted by the elevator. An important feature of the present invention is that the toothed die elements 18 are placed against the pipe 14 during the described setting procedure with only the force required to contact the pipe without damaging the pipe surface. To this end, the pipe dies 18 and wedge sections 19 are carried on the slip segments 16 such that the slip dies 15 may be set without setting the dies 18.

If the pipe 14 slips through the set dies 15, the downward movement of the pipe pulls the toothed die 18 down against the wedge section 19 causing the die 18 to move radially into firm gripping and holding engagement with the pipe.

Figure 2:
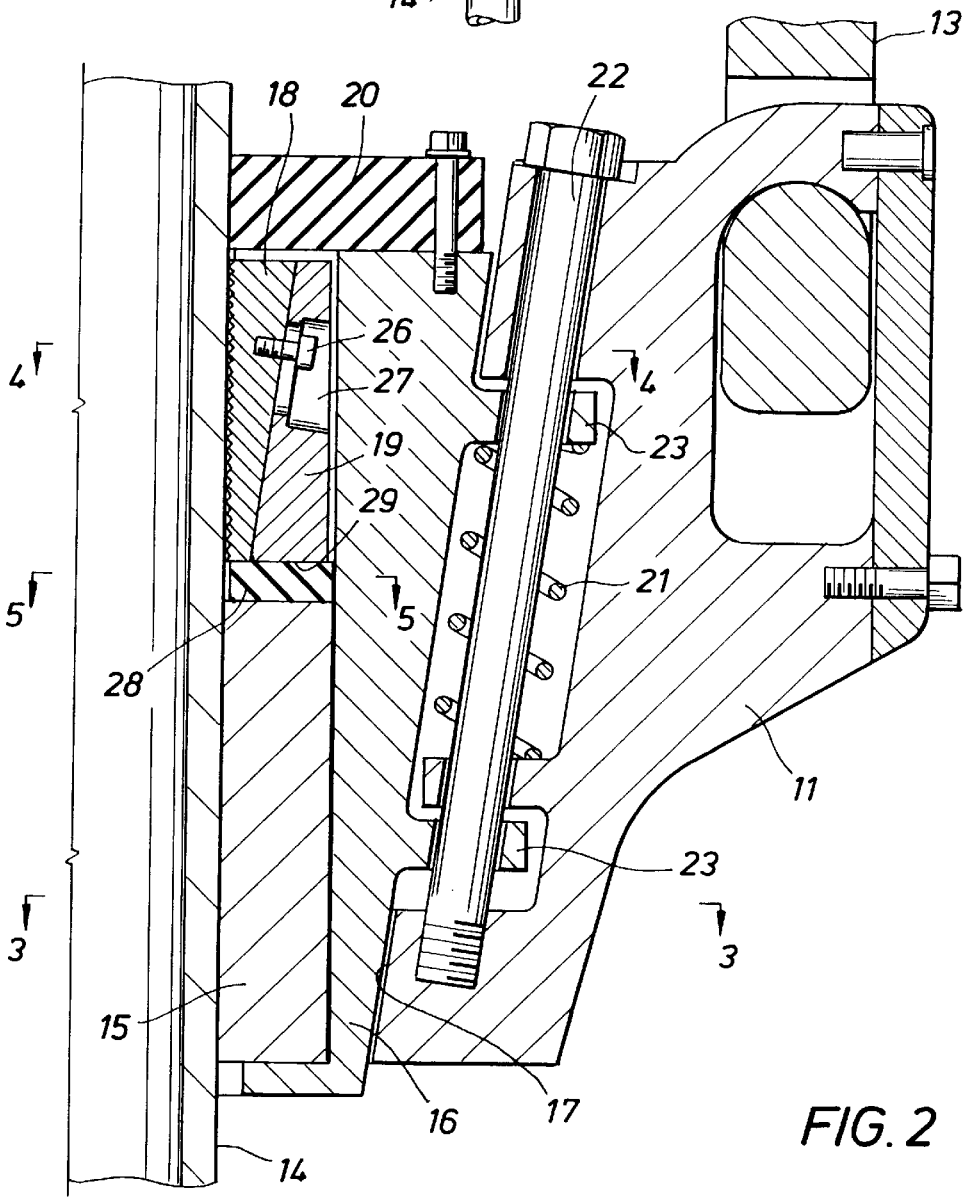
FIG. 2 is a detailed vertical sectional view of the pipe gripping assembly of the present invention illustrating the primary pipe gripping slip elements initially engaging a pipe before gripping and hold the pipe.

FIGS. 2 and 3 illustrate details in the construction and operation of a conventional, single bowl elevator equipped with the gripping and holding apparatus of the present invention. The elevator 11 carries four tapered slip segments, as indicated in FIG. 3, that encircle the pipe 14 when the elevator is closed. As best illustrated in FIG. 2, each segment 16 is biased upwardly away from the slip bowl surface 17 by a coil spring 21. A mounting bolt 22 extends through retaining ears 23 in each segment 16 to position and hold the segments within the elevator.

As illustrated best in FIG. 3, the dies 15 dove-tail in slots 24 formed in the slip segments 16. The dies 15 are equipped with a uniform, substantially smooth pipe contact surface 25 that engages the pipe when the elevator is set. The dies 15 are selected to provide as much surface contact with the pipe 14 as possible to maximize the frictional gripping forces exerted by the elevator.

Referring to FIG. 4, the secondary gripping and holding mechanism comprising the toothed pipe die 18 and wedge section 19 are carried in the upper section of the dove-tail slot 24 formed in the slip segments 16. As best illustrated by joint referent to FIGS. 2 and 4, the die section 18 is secured to the wedge section 19 by a screw 26 that extends through a slot 27 formed in the section 19. The slot 27 extends axially to permit limited axial movement of the screw 26 and attached die section 18 over the wedge section 19.

Figure 5:
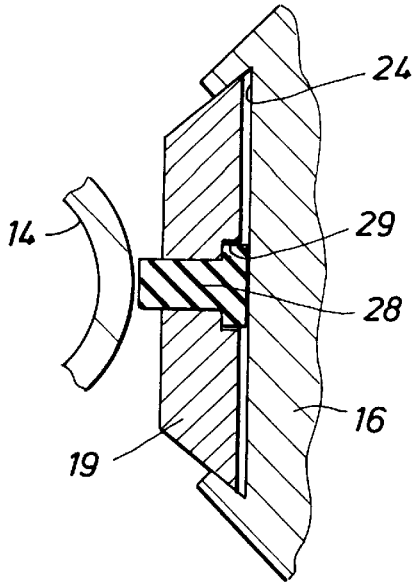
FIG. 5 is a partial horizontal cross sectional view taken along the line 5—5 of FIG. 2 illustrating details in the secondary pipe gripping mechanism.

The contact force of the die section 18 against the pipe when the slips are set is controlled with the assistance of a biasing mechanism 28 that urges the die section 18 away from the bowl surface 17. As best illustrated in FIGS. 2 and 5, the biasing mechanism 28 comprises a resilient T-shaped member that is disposed in a T-shaped slot 29 at the base of the section 19 between the wedge section 19 and the base of the slot 29.

In operation, the elevator 11 is closed around the pipe 14, so that the elevator and the pipe are substantially coaxially aligned. The rig is operated to move the elevator axially relative to the pipe. This axial movement between the elevator and the pipe drags the wiper elements 20 along the pipe causing the slip segments 16 to be moved axially downwardly against the biasing force of the spring 21 and into engagement with the tapered bowl surface 17. The interaction of the tapered slip segments 16 and bowl surface 17 moves the segments radially toward the pipe causing the dies 15 and 18 to engage the pipe 14. The radially directed gripping forces exerted by the dies 15 continue to increase as the axial lifting force exerted by the elevator 11 increases. When the radial forces on the dies 15 create sufficient axially directed forces on the pipe due to the friction coefficient between the dies 15 and the pipe 14, the slips 15 are "set" and the pipe 14 moves up with the elevator 11. During the described process of setting the smooth dies 15, the initial radial movement of the toothed, nonsmooth dies 18 compresses the biasing member 28 against the slip segment 16 which limits the radial force exerted on the pipe. The T-slot 29 in the wedge section 19 is oversized to accommodate the increased lateral dimensions of the compressed material of the biasing element 28. When the slip dies 15 are initially set, the dies 18 are in engagement with the pipe but are not exerting as much radial force against the pipe as is being exerted by the dies 15. The amount of radial force exerted by the dies 18 may be determined by appropriately sizing or adjusting the biasing member 28. In the preferred embodiment of the invention, the back of the wedge section 19 will seat against the base of the slot 24 after the dies 15 are gripping and holding the pipe.

In the event the pipe 14 begins to slip through the dies 15, the movement of the pipe will drag the die segments 18 downwardly relatively to the wedge section 19. With the segment 19 against the base of the slot 24, this relative axial movement between the two tapered surfaces causes the dies 18 to move radially into gripping and holding engagement with the pipe.

An alternate embodiment of the present invention is illustrated generally at 50 in FIG. 6 of the drawings. The gripping and holding mechanism 50 is comprised of a primary gripping mechanism indicated generally at 51 and a secondary gripping mechanism indicated generally at 52. The primary mechanism 51 is provided by a slip segment 53 that carries a smooth pipe contact die 54. The secondary mechanism 52 is provided by a slip segment 54 that carries a nonsmooth, toothed pipe contact die 55. An adjustment bolt 56 connects the two segments 53 and 54. The bolt 56 extends through a bore 57 formed through the slip segment 54. A biasing member 58 separates the two slip segments and urges them apart. A nut 59 on the top of the bolt may be rotated on the bolt threads to adjust the axial spacing between the two slip segments. While the biasing member 58 is illustrated as a metal spring component, it may be formed by any suitable biasing means such as, for example, a Beliville washer, a rubber pad, a coil spring, or other means.

The apparatus 50 may be employed in a conventional elevator such as an HYT or YT elevator or other similar device. In such devices, the two die segments 54 and 53 may replace each of the four single slip segments employed to hold the pipe dies.

In operation, an elevator equipped with the gripping and holding assembly 50 is. closed on the pipe and the die 54 are set as previously described with reference to the apparatus of FIGS. 1–5. The dies 54 set against the pipe with the toothed dies 55 in contact with the pipe but not set in gripping and holding engagement.

If the pipe 14 slips through the primary gripping and holding assembly 51, the slip dies 55 are drawn down pulling the tapered slip segment 54 into engagement with a tapered bowl surface 60. This axial movement of the segment 54 relative to the segment 53 and bowl surface 60 forces the dies 55 radially into gripping and holding engagement with the pipe.

In a preferred form of the invention, when running metallic pipe, the smooth surface dies such as the dies 15 and 54 are constructed of a material that is softer than the material of the pipe. By way of example, rather than limitation, an aluminum alloy may be used for such dies when the pipe is of primarily steel construction.

It will be appreciated that while the invention has been described for use in a conventional slip grip, center latch elevator, it is equally applicable to any conventional elevator, spyder or slip mechanism. The invention may also be employed with any conventional system of slip actuation including air operated or hydraulically operated slip action. The basic principles of operation of the invention are also applicable to use in casing running tools as well as tubing running tools.

Figure 7:
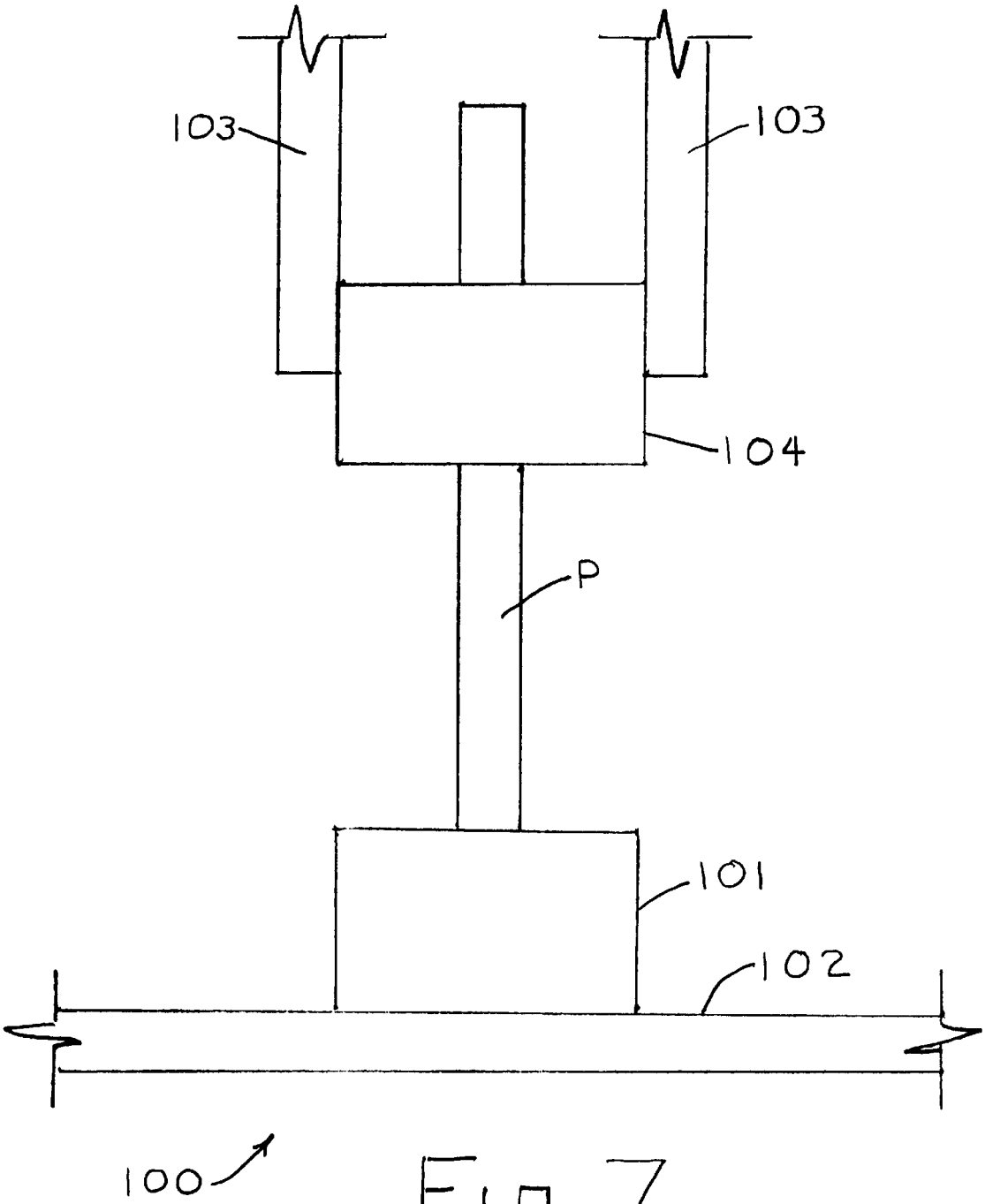
FIG. 7 illustrates a system indicated generally at 100 employing the pipe gripping mechanisms of the present invention to run or remove pipe P in a well (not illustrated). The system 100 includes a stationary spyder 101 resting on a conventional or drilling workover rig floor 102. Conventional bales 103 connect to an elevator 104 to move the elevator vertically relative to the stationary spyder 101.

FIG. 7 illustrates a system indicated generally at 100 employing the pipe gripping mechanisms of the present invention to run or remove pipe P in a well (not illustrated). The system 100 includes a stationary spyder 101 resting on a conventional or drilling workover rig floor 102. Conventional bales 103 connect to an elevator 104 to move the elevator vertically relative to the stationary spyder 101.

The spyder 101 and the elevator 104 each operate as a gripping device in a manner described previously with reference to the specific embodiments of the invention illustrated in FIG. 1 and/or FIG. 6. The spyder 101 and elevator 104 are selectively opened or closed, in a conventional sequence, to either raise or lower the pipe P as the bales 103 are raised or lowered relative to the rig floor 102.

In the method of the present operation, the actuation of the secondary pipe gripping and holding mechanism occurs automatically. Thus, it is not necessary to initiate any manually operated procedure after the primary gripping assembly is set in order to enable the secondary gripping assembly for operation.

Accordingly, while the preferred embodiments of the assembly and method of the present invention has been described herein, it will be appreciated that various modifications in the construction and operation of the described system and method may be made without departing from the spirit and scope of the invention.

What is claimed is:

1. A pipe gripping apparatus adapted to encircle and grip an axially extending pipe, comprising:

a tapered slip bowl having a central axis and adapted to encircle and align axially with said pipe, first tapered slip elements carried in said slip bowl and adapted to move radially relative to said central bowl axis into pipe gripping engagement with said pipe as said first slip elements move axially relative to said bowl, second tapered slip elements carried by said slip bowl and movable relative to said first slip elements into pipe gripping engagement with said pipe, and a connecting mechanism for holding said first and second slip elements relative to each other whereby the pipe gripping force exerted on said pipe by said second slip elements increases as said pipe moves axially relative to said first slip elements.

2. A pipe gripping apparatus as defined in claim 1 wherein said second slip elements comprise tapered slip sections having pipe gripping teeth formed along pipe contact surfaces of said slip sections and tapered slip backing sections contacting said tapered slip sections for moving said pipe contact surfaces radially as said slip sections and said backing sections are moved axially relative to each other.

3. A pipe gripping apparatus as defined in claim 2 further comprising:

slip section biasing structure for urging said tapered slip sections in a radial direction away from said central bowl axis whereby said tapered slip sections initially contact said pipe with less pipe gripping force than the pipe gripping force exerted by the initial contact of said pipe by said first slip elements.

4. A pipe gripping apparatus as defined in claim 3 further comprising:

an adjustment structure for adjusting the radial position of said tapered slip sections relative to said central bowl axis.

5. A pipe gripping apparatus as defined in claim 1 wherein said connecting mechanism further comprises:

an adjustment structure for adjusting the radial position of said first and second slip elements relative to each other.

6. A pipe gripping apparatus as defined in claim 1 further comprising:

a nonsmooth pipe contact area on said second slip elements for increasing the gripping ability of said second slip elements, and relatively smooth pipe contact areas on said first slip elements for engaging said pipe with minimal surface damage to said pipe surface.

7. A pipe gripping apparatus as defined in claim 6 wherein said second slip elements comprise tapered slip sections having pipe gripping teeth formed along said nonsmooth pipe contact area of said slip sections, and tapered slip backing sections contacting said tapered slip sections for moving said nonsmooth pipe contact area radially as said slip sections and said backing sections are moved axially relative to each other.

8. A pipe gripping apparatus as defined in claim 7 wherein said second slip elements comprise slip section biasing structure for urging said tapered slip sections in a radial direction away from said central bowl axis whereby said tapered slip sections are adapted to initially contact said pipe with less pipe gripping force than the pipe gripping force exerted by the initial contact of said pipe by said first slip elements.

9. A pipe gripping apparatus as defined in claim 8 wherein said second slip elements comprise an adjustment structure for adjusting the radial position of said tapered slip sections relative to said central bowl axis.

10. A slip assembly to be employed for gripping and holding an axially extending pipe comprising:

a tapered slip bowl having a central axis;

a first tapered slip adapted to be positioned in said bowl whereby tapered surfaces between said first slip and said bowl cause said first slip to move radially relative to said central bowl axis as said first slip moves axially relative to said bowl;

a second tapered slip adapted to be positioned in said bowl whereby tapered surfaces between said second slip and said bowl cause said second slip to move radially relative to said central bowl axis as said second slip moves axially relative to said bowl;

a pipe contact portion of said first slip comprising a smooth pipe contact surface adapted to engage the outer cylindrical surface of a pipe when such pipe extends axially through said slip bowl, said pipe not being a part of said assembly, said smooth pipe contact portion being constructed from a material softer than steel to be contacted whereby said smooth pipe contact portion is adapted to be extruded into the surface irregularities of the pipe as said first slip is moved radially into the pipe; and a pipe contact portion of said second slip comprising a nonsmooth pipe contact surface adapted to engage said outer cylindrical surfaces of the pipe to be contacted.

11. A pipe gripping and holding system comprising:

first and second pipe gripping mechanisms carried within a primary slip bowl for gripping and holding a pipe, smooth pipe contact elements in said first pipe gripping mechanism operable to be set for engaging and holding said pipe, and non-smooth pipe contact elements in said second pipe gripping mechanism automatically operable by pipe movement occurring after said smooth contact elements are set to grip and hold said pipe.

12. A pipe gripping and holding system as defined in claim 10 for gripping and holding a pipe that is separate from said system, said pipe not being a part of said system, wherein said smooth contact elements are constructed of a malleable material softer than steel.

13. A pipe gripping and holding system as defined in claim 12 wherein said smooth contact elements are constructed of an aluminum alloy.

14. A pipe gripping and holding system as defined in claim 11 wherein said primary slip bowl and said first and second pipe gripping mechanisms comprise a stationary pipe gripping and holding assembly and further including a movable pipe gripping and holding assembly, movable relative to said stationary assembly, whereby said system may run or remove a string of pipe in a well.

15. A pipe gripping and holding system as defined in claim 14 for gripping and holding a pipe that is separate from said system, said pipe not being a part of said system, wherein said smooth contact elements in said stationary assembly and said moveable assembly are constructed of aluminum.

16. A method of handling pipe comprising the steps of:

setting smooth pipe contact elements in a primary tapered bowl slip assembly against a pipe, resting the weight of said pipe on said smooth pipe contact elements, and placing non-smooth pipe contact elements in said primary tapered bowl slip assembly against said pipe whereby said non-smooth pipe contact elements are set to grip and hold said pipe in said primary tapered bowl slip assembly by pipe movement occurring after said smooth pipe contact elements are set.

17. A method as defined in claim 16 wherein said steps are applied by stationary and moveable slip assemblies of a drilling or workover rig.

18. A method as defined in claim 16 further comprising the steps of removing the weight of said pipe from said smooth contact elements and then removing said non-smooth pipe contact elements from said pipe.

* * * * *